US005240340A

United States Patent [19]

Lynch et al.

[11] Patent Number: 5,240,340

[45] Date of Patent: Aug. 31, 1993

[54] BOOKS AND ASSEMBLIES FOR BOOKS

[75] Inventors: Peter F. Lynch; Scott W. Osiecki; Robert L. Naas, all of Skaneateles, N.Y.

[73] Assignee: Cullman Ventures, Inc., Sidney, N.Y.

[21] Appl. No.: 796,583

[22] Filed: Nov. 22, 1991

[51] Int. Cl.[5] ..... B42F 3/00

[52] U.S. Cl. ..... 402/79; 281/15.1; 281/16; 281/31; 402/4; 402/80 R

[58] Field of Search ..... 281/15.1, 16, 31; 402/4, 79, 80 R; 283/36, 37, 38

[56] References Cited

U.S. PATENT DOCUMENTS

| | | | |
|---|---|---|---|
| 166,284 | 8/1875 | Lovell | 283/37 |
| 464,417 | 1/1891 | Bevin | 281/16 X |
| 482,612 | 9/1892 | Bevin | 281/16 |
| 512,943 | 1/1844 | Brownell | 281/16 |
| 2,490,147 | 12/1949 | Minton | 281/42 |
| 2,541,735 | 2/1951 | Albrecht, Jr. | 281/42 |
| 2,795,059 | 6/1957 | Mendelsohn | 281/16 X |
| 3,620,552 | 11/1971 | Woodcock et al. | 281/16 X |
| 4,932,683 | 6/1990 | Perazza | 283/37 X |
| 5,048,869 | 9/1991 | Schwartz | 402/4 X |

FOREIGN PATENT DOCUMENTS

| | | | |
|---|---|---|---|
| 7638 | of 1889 | United Kingdom | 281/16 |

*Primary Examiner*—Paul A. Bell

*Attorney, Agent, or Firm*—Richard G. Stephens

[57] ABSTRACT

An improved leaf assembly for incorporation into a book, or formed as part of a cover of a book, to allow selective placement of a page adjacent or atop a selected leaf of the book.

6 Claims, 6 Drawing Sheets

BOOKS AND ASSEMBLIES FOR BOOKS

Our invention relates to dated books such as appointment books and diaries, and other books, and to special configurations of leaves or pages for use within such books. In the ensuing discussion, we will call a sheet having two sides a "leaf", and we will call the two sides of a leaf two pages. Thus in a typical book, a leaf might have a first side numbered page 261 and an opposite side numbered page 262. In a general sense all or most pages of an ordinary book tend to pivot about an axis located at, or approximately at, the "spine" of the book. In most books a given leaf always lies, when the book is closed, within a volume defined by the front and rear covers of the book. A page which lies within such a volume (as do most pages in usual books) will be deemed to be in a "normal" page position. A page which has been moved so that both of its vertically-extending edges have been moved a substantial fraction of a page width, or a page width or more, from the spine axis will be deemed a page moved to an "extended" page position.

It is frequently desirable to display the text or data on one page (we will call it a "reference" page) of such a book directly alongside another page (we will call it a "target" page) of the book, either to compare data on the two pages, or to copy data from the reference page to the target page. The text or data on a given page tends to automatically be displayed alongside the succeeding page on the next leaf in an ordinary book, but the text or data on the one page cannot be displayed alongside other pages, tending to require that the user flip back and forth between page locations to transfer data from the one page. That requirement delays data comparison, entry and/or calculation, and may cause error. By way of one simple example, it is often very advantageous to be able to position a "note pad" adjacent or side-by-side a reference table to facilitate calculations made on the notepad, and then further be able to position the notepad adjacent some other appropriate page of the book, to copy the results of the notepad calculations as permanent entries on that appropriate page.

The broad idea of providing a "floating" reference page which can be positioned alongside or generally near any desired other page, or "target" page, of the book is old and shown in U.S. Pat. No. 2,490,147 (Minton). A swinging wire frame structure shown in Minton allows a reference bookmark, or a reference page carrying any type of data, to be positioned in between or alongside many pairs of leaves of a book.

It also has been previously suggested in (U.S. Pat. No. 5,048,869) that a special form of leaf assembly may be pivotally carried on a swinging frame of generally the type shown by Minton. The special assembly comprised a first page-size leaf having its left edge pivotally attached to an outer leg of a swinging frame, and a rigid strip pivotally connecting the right side of the first leaf to a second leaf near the lateral centerline of the second leaf.

A book with which the user may physically locate one or more reference pages directly alongside two or more target pages to make a leaf of the reference page visible directly alongside a target leaf may be said to have a capability of "selective page placement", and the greater the number of different target pages beside which the reference page (or pages) can be placed, the greater is that capability of selective page placement.

One object of the present invention is to provide a book page assembly, or a book, which provides substantial page placement, but which does not require a swinging wire (or equivalent) frame.

Another object of the invention is to provide a book page assembly or a book having selective page placement which can be manufactured less expensively than any books having comparable selective page placement shown in the prior art.

As is the case of ordinary record-keeping books, the overall ease of use and general utility of such a book may be greatly enhanced if various of the pages of the book may carry an index tab on the outer edge of such a page. Prior art devices having selective page placement tend to enclose book pages so that index tabs are not visible and hence cannot effectively be used. Another object of the present invention is to provide a book having selective page placement in which various pages may carry index tabs.

The utility of a book having selective page placement may be materially increased if a "floating page", or reference page, may be slid outwardly from a normal page position to an extended page position without a need to appreciably open the book. In some uses of such a book, such as on an uncluttered desk or table, a need to open such a book causes little inconvenience to the user, but in some other cases an ability to extract a reference page without having to appreciably open the book becomes very advantageous. Using such a book inside a conventional telephone booth is one example. Thus another object of the present invention is to provide a book page assembly, or a book, in which a "floating page", or reference page, can be slid outwardly from a normal page position to an extended page position without a need to appreciably open the book.

A book having selective page placement generally is more useful if it incorporates many ordinary pages, such as one leaf, or at least one page, for each day of a calendar year, plus added pages carrying reference data, tables, maps or like indicia. It is highly desirable that such a book lie flat when placed in a closed condition, rather than tending to swing toward a partially open condition. Another object of the invention is to provide a book having selective page placement which will lie flat in a closed condition even though the book contains many pages.

It is also desirable in a book having selective page placement that a floating or reference page be capable of being placed in a uniform position with respect to any of many target pages. As one simple illustration, it is desirable that a given edge of a reference page be placeable the same distance from a spine edge of a given target page, whether the target page is page 1 or page 365 of the book. Thus another object of the present invention is to provide a book, or a page assembly for a book, which allows uniform placement of a reference page relative to any of many target pages of the book.

It has been suggested in prior art that selective page placement be provided by hingedly attaching a rigid connector strip to the outer edge of an ordinary book page having its inner edge captured at the book spine, with the other edge of the connector strip being hingedly attached to the vertically-extending centerline of a platform leaf on which one or more of a variety of devices may be carried. In accordance with one important concept of the present invention at least one more, and what may be many, many more hinge connections are provided between the ordinary page and the platform leaf. As will become clear below, provision of a second hinging axis between the ordinary page and the platform leaf, with the second hinging axis spaced from the hinged connection at the edge of the ordinary leaf in accordance with the number of leaves intended to be used within the book, allows a large number of pages to be included within the book yet allows the book to lie fully closed. Thus another object of the present invention is to provide a book page assembly or book in which two or more hinged connections are made between an ordinary leaf and a platform leaf.

In accordance with another concept of the present invention, provision of a second hinging axis, and indeed, many more hinging axes, is accomplished by provision of one or more slots in a page assembly. Provision of the one or more slots (cutouts) in such an assembly not only provides the second axis which allows the book to lie flat, but it also allows the use of index tabs, so that the user may readily locate desired sections within the book. A book leaf formed from a thick plastic sheet, or from a stiff cardboard backing, plastic-covered or not, tends to provide a rigid or semi-rigid leaf. But if that leaf has a slot (or slots) extending through much of its height, the leaf becomes flexible throughout the width of those slots, tending to provide a multiple-axis hinge. And, the slot (or slots) not only provide the desired extra hinging, but they also readily accommodate the use of edge tabs necessary to increase the utility of the book.

As will become clear below, in various forms of the invention a hinged leaf assembly may be used either as an "inside" leaf of a book, i.e., a leaf which lies in between the front and rear covers of a book, or conversely, a hinged leaf assembly may comprise either the front cover or rear cover of a book. The term hinged leaf assembly will generally be used to mean an assembly which has a width greater than an ordinary page of the book, and which incorporates a hinging section and carries a platform leaf.

Other objects of the invention will in part be obvious and will in part appear hereinafter.

The invention accordingly comprises the features of construction, combinations of elements, and arrangement of parts, which will be exemplified in the constructions hereinafter set forth, and the scope of the invention will be indicated in the claims.

For a fuller understanding of the nature and objects of the invention reference should be had to the following detailed description taken in connection with the accompanying drawing(s), in which.

Figure 15:
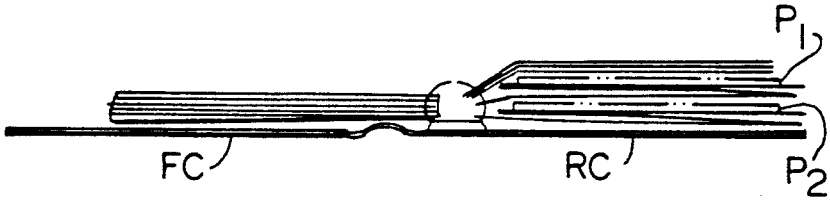
FIG. 15 is an end elevation view illustrating a wire-bound book incorporating two hinge pages according to the invention, one hinge page comprising the last page of the book, and a second hinge page constituting the penultimate page of the book.
Figure 17:
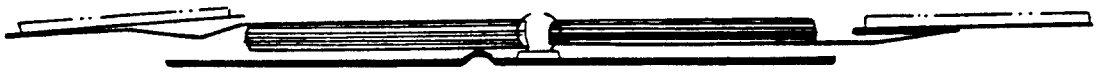

FIG. 17 an end elevation view showing the two hinge pages of the book of FIG. 15 moved to another pair of positions.

Figure 18:
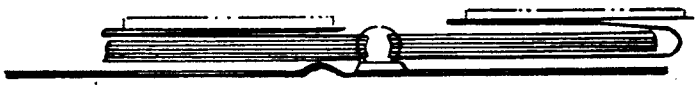

FIG. 18 is an end elevation view of a book containing two hinged leaves with the platform pages of the two hinged leaves placed side-by-side.

Figure 19:
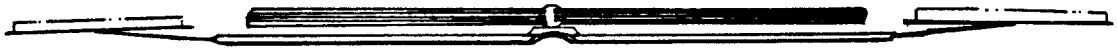

FIG. 19 is an end elevation view of a book containing two hinged pages with the platform pages of the two hinged leaves both pulled to extended positions.

Figure 20:
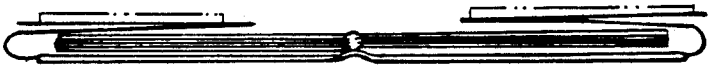

FIG. 20 is an end elevation view of a book wherein two hinge page assemblies are integral parts of the front and rear covers the book.

Figure 21:
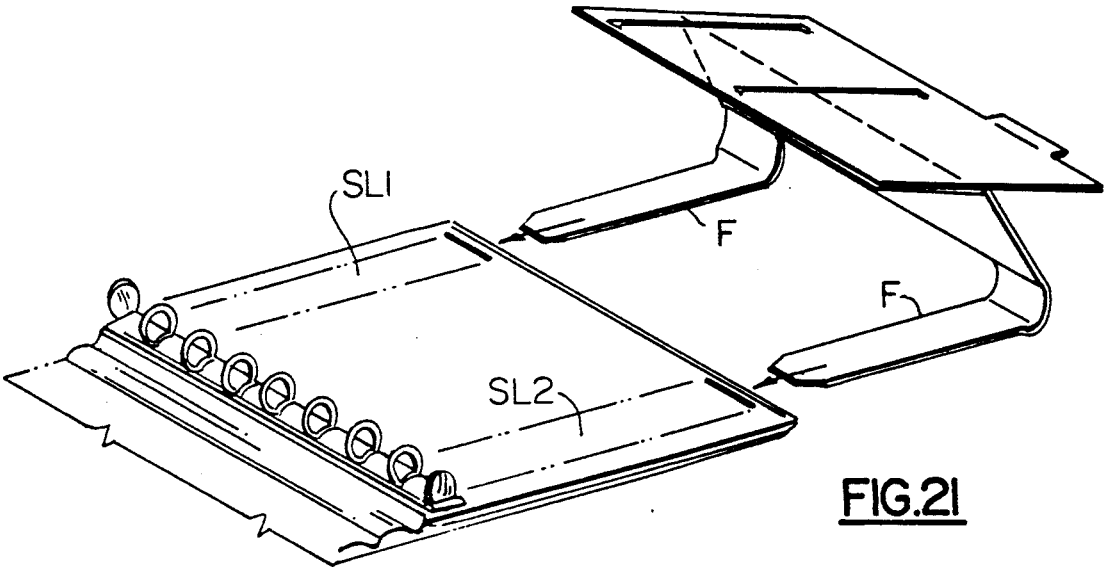

FIG. 21 is an exploded isometric view of a modified form of hinged leaf assembly and a portion of a book, in which the hinged leaf assembly is mounted in the book by finger portions which fit into pockets provided in the rear cover of the book.

Figure 8:
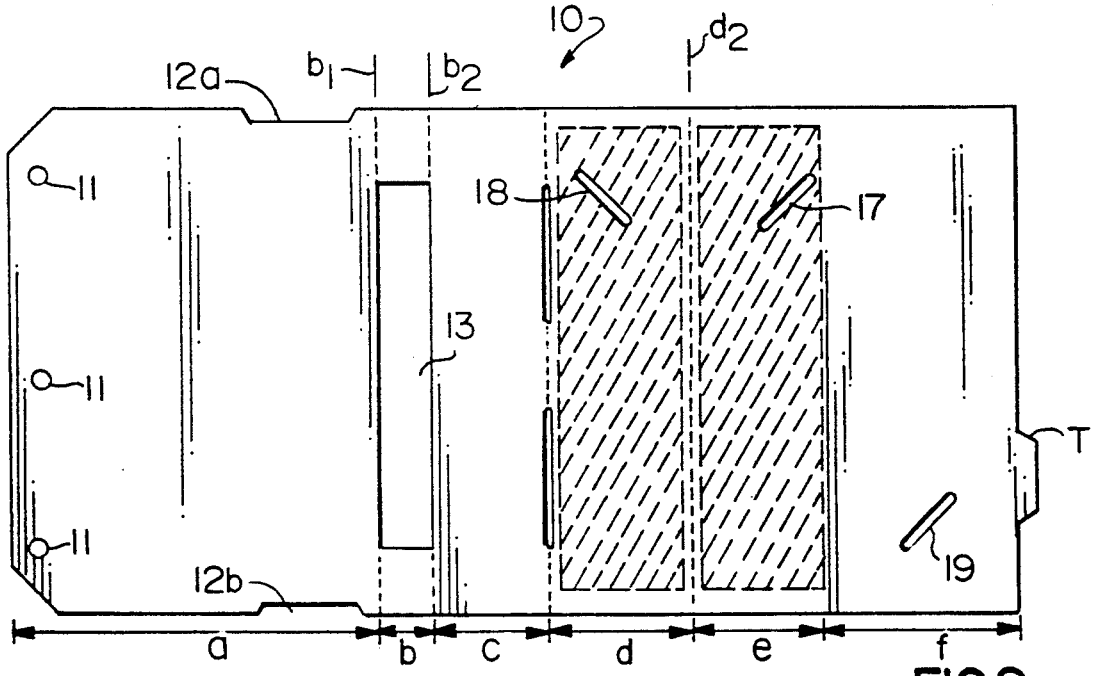
FIG. 8 is a plan view of one form of stamping which may be used to make a hinged page in accordance with the invention.
Figure 9:
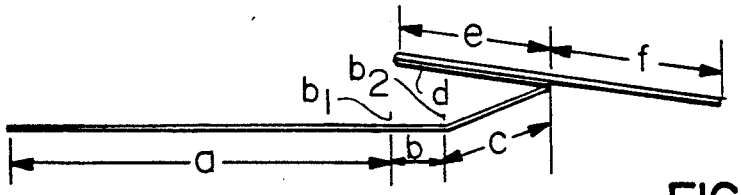
FIG. 9 is an end view of the stamping of FIG. 8 after it has been folded and attached in a manner to be described.

Various features of one form of the present invention may be best appreciated by an initial reference to FIGS. 8 and 9. In FIG. 8 a flat sheet-like stamping 10 is shown. The stamping 10 may comprise a plastic sheet formed of vinyl, for example, or various other plastics, or it may comprise paper, cardboard or the like provided with a plastic covering. In a typical application the stamping may comprise vinyl having a thickness of 0.020 to 0.040 inch. In any event it will be apparent that stampings of the type shown may be readily and rapidly produced by simple stamping operations. The stiffness of the stamping is not critical, though it will usually be more than that of ordinary leaves intended to be used in the book.

In the FIG. 8 stamping 10 is shown with three through holes 11,11 adjacent its leftside edge for use of the assembly in a conventional 3-hole ring binder. That left edge may instead be formed to accommodate wire-binding, stitching, gluing, or other forms of binding commonly used for multi-page books.

Stamping 10 may be seen to be generally rectangular. A first width portion a of the stamping has a width approximating that of an ordinary page of a book. Two locator notches **12*a*,12*b* are shown at the upper end lower edges of that width portion of the stamping. As will become clear below, as the description proceeds, the provision of such a notch on either the top edge, or on the bottom edge, or preferably on both such edges, greatly facilitates the user's finding of where to replace the hinged leaf when the hinged leaf is in an extended position. By feeling along the upper or lower edge of the platform page until one's finger encounters one of the notched portions, the pages covering the platform page then lie atop one's finger and can be easily lifted, allowing the hinged leaf to be returned to its original position with minimum fumbling. Immediately rightwardly from width portion a of the stamping, a width portion b of the stamping includes an elongated slot 13. The width b is selected in accordance with and proportional to the number of pages to be included in a book. Assuming that the basic height of stamping 10 has a given stiffness, or resistance to folding about a vertical (in FIG. 8) axis, it will become apparent that provision of slot 13 renders the stamping much less resistant to folding about any axis at or in between axes $b_1$ and $b_2$. Indeed, if the vertical length of slot 13 made it extend from nearly the upper edge of portion b to near the lower edge of portion b, so that only thin "thread" portions connected portion a to portions c and those rightward it would be wholly apparent that portion a could be readily folded about any vertical axis laterally between axes $b_1$ and $b_2$. However, even if slot 13 has a lesser height than that shown, it should be apparent that the stamping may be readily folded about axis $b_1$ and axis $b_2$, virtually irrespective of the thickness of the stamping, if score or fold lines are provided along axes $b_1$ and $b_1$. Significantly, the provision of fold lines spaced apart as at $b_1$ and $b_2$ allow a double folding between portion a and portions rightward from portion b. Further, slot 13** allows index tabs to protrude therethrough, as will be seen below.

Figure 10:
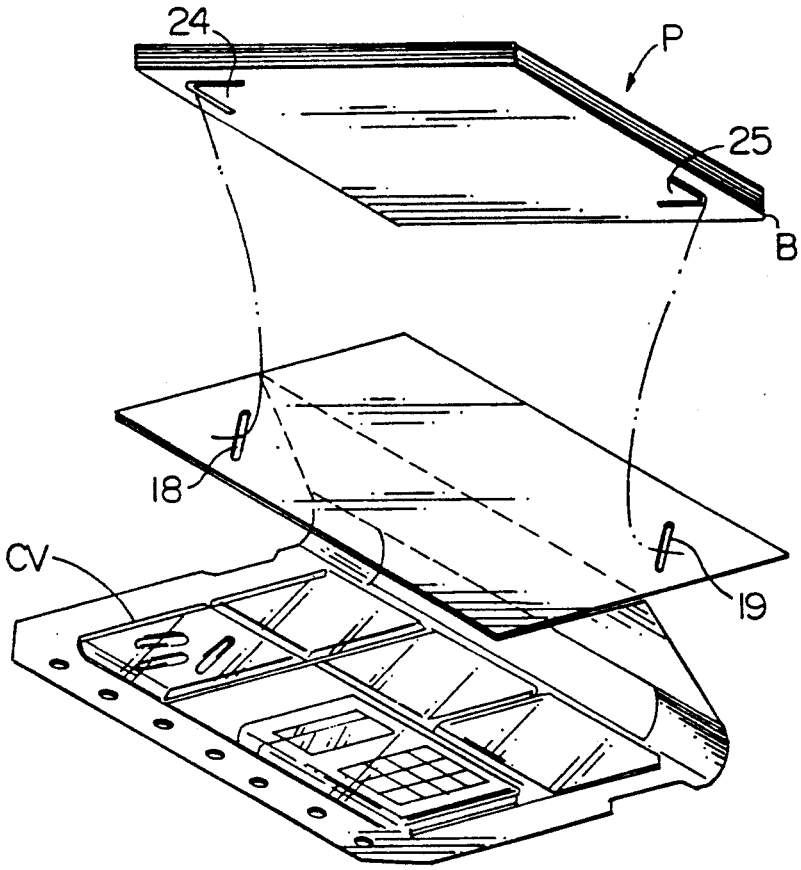
FIG. 10 is an exploded view showing various details of one form of the invention.

Rightwardly from portion b in FIG. 8 are shown portions c, d, e, and f of the stamping. Portions c, d, e, and f each has a width approximating one-half a page width. Width portion d includes an angularly-extending through slot 18 shown extending at a $-45°$ angle from vertical axis $d_2$, width portion e includes an angularly-extending through slot 17 extending at a $+45°$ angle from the vertical axis and width portion f includes an angularly-extending through slot 19 extending at a $+45°$ angle from the vertical axis. Width portions d and e are shown shaded to represent glue-bearing surfaces. Stitching or other attachment means could be substituted for gluing. Assume that the stamping is folded 180° along axis $d_2$ and glued so that portion e overlies portion d, with angular through slot 17 overlying and registering with angular through slot 18. A fold line may be easily provided at axis $d_2$ during stamping to accommodate such folding. Then, an end elevation view of the stamping 10 after portion e has been glued or cemented to portion d will correspond to the view shown in FIG. 9. It is significant that fold lines have been provided at axis $b_2$ as well as at axis $b_1$, if indeed if not at many, many points between axis $b_1$ and $b_2$. In FIG. 9, portions d, e and f form a platform leaf, which may be located alongside any page within the book. The platform leaf may be fashioned to carry a wide variety of different articles, such as common pads of adhesively secured pages, or pads carrying adhesive-carrying leaves designed to be transferred, e.g., "Post-It" (trademark) notes, means for holding wirebound telephone-address books, or electronic calculators, and various other items. Pads or like devices may be removably fastened on the platform leaf by means of slots 18,19 as best shown in FIG. 10, or by means of an overlying slitted sheet as will be explained in connection with FIG. 3.

FIGS. 8 and 9 show the hinge leaf assembly in a position such that the assembly would comprise a *right-hand* leaf of a book, i.e., so that portions e and f face upwardly if a book containing the hinge leaf is opened and all leaves atop the hinge leaf are swung *leftwardly* to bare the hinge leaf. Assume, however, that the stamping of FIG. 8 were rotated 180°. Then it should become apparent that the assembly conversely would comprise a *lefthand* leaf of a book, so that portions e and f would face upwardly if a book containing the hinge leaf were opened and all leaves atop the hinge leaf were swung *rightwardly* to bare the hinge leaf. Thus a hinge leaf assembly of the type shown in FIGS. 8 and 9 can be used in either a righthand or a lefthand manner. If such a hinge leaf assembly is permanently fastened in a book with its spine edge (the left edge of portion a in FIG. 8) by stitching or gluing, such a leaf obviously cannot be moved between such righthand and lefthand conditions, but if the hinge leaf is used in a book using a conventional ring binder, or wire binding permitting leaf removal and insertion, the leaf may be used by the user for either righthand or lefthand operation. These hinge leaf assemblies of the type generally shown in FIGS. 8 and 9 may be incorporated into books, or sold separately for incorporation into existing books.

In FIG. 8 a tab portion T of stamping 10 extending at the righthand side of portion f is shown located near the lower (in FIG. 8) part of the edge of portion f. If the stamping were rotated 180° as described above, the tab T would, of course, be located near an upper part of the edge of portion f. It will be apparent that a plurality of stampings generally of the type shown in FIG. 8 may be provided, with tab portions spaced at a variety of different vertical locations along the outer edge of width portion f, for use of such hinged leaves in a variety of book configurations.

Figure 1:
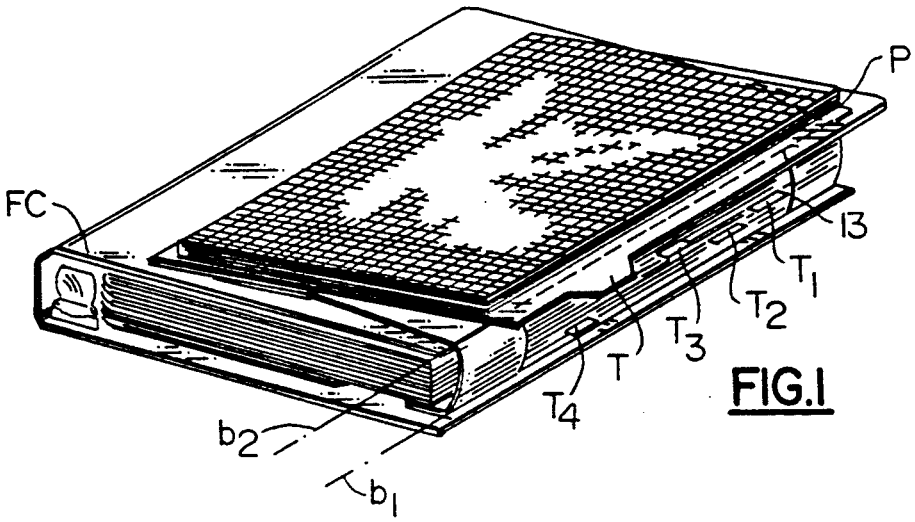
FIG. 1 is an isometric view of one form of book incorporating the present invention in which a pad carried on a hinged page assembly is shown extracted from between the front and rear covers of the book and placed atop the front cover of the book.
Figure 2:
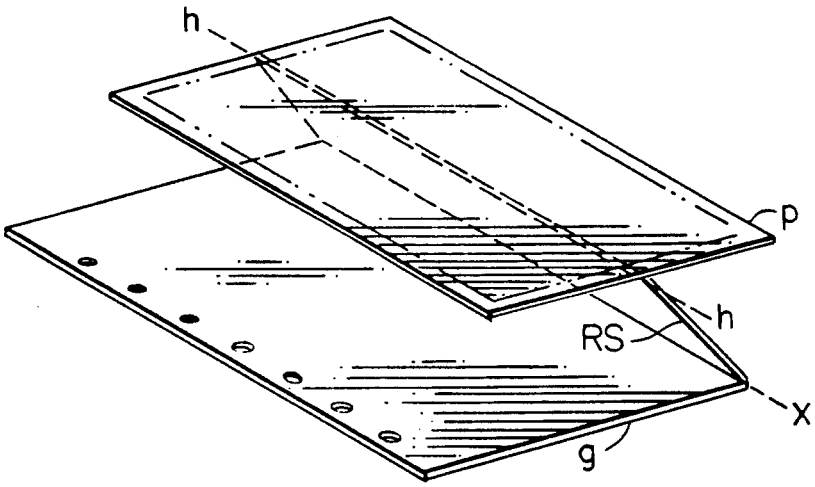
FIG.2 Prior Art
FIG. 2 is an isometric view of an elementary form of hinged page assembly which is known in the prior art.

Referring now to FIG. 1, a book utilizing a hinged page of the nature shown in FIGS. 8 and 9 is shown installed in a conventional multi-ring binder, as the last inside page thereof, with the book shown very slightly open for sake of clarity of illustration. The hinged leaf is shown as carrying a simple and conventional multi-leaf pad P on its platform section. The platform leaf is shown as including an extending tab portion T. One may pull the platform leaf from anywhere it might be hidden among the pages of the book by merely grasping and outwardly pulling its index tab T to extend the platform leaf, after which the platform leaf carrying pad P simply may be pushed atop the front cover FC to the position shown, or instead pushed atop any rightside leaf within the book. The hinge leaf portion b is shown surrounding all the ordinary non-extendible pages of the book, and the front cover FC of the book, with axis b located adjacent the last ordinary page of the book, and axis $b_2$ lying just atop the front cover of the book. Having hinge axes at both $b_1$ and $b_2$, many, many ordinary pages may be included in the book, with the book still arranged to lie flat in its closed condition. With slot 13 being provided in width portion b, numerous tabs $T_1$, $T_2$, $T_3$, etc. carried on the edges of ordinary pages extend through slot 13 and remain visible to the user, though they are encompassed by slot 13 of the hinge leaf. While none of the ordinary pages carrying tabs $T_1$ to $T_4$ can be seen when the platform leaf carrying pad P lies atop front cover FC, the presence of the various sections of the book remain visible, and the user can rapidly locate pad P adjacent any page of any of those sections by simply pulling the platform page to an extended position, grasping a selected one of tabs $T_1$ to $T_4$, flipping pages above that tabbed page leftwardly, and then pushing the platform page again leftwardly to place pad P adjacent the selected tabbed page. More importantly, the provision of slot 13 allows a hinged leaf positioned further back in the book to clear the tabs of any other hinged leaf assemblies, with no interference with the latter. The arrangement shown in FIG. 1 offers significant advantages over the prior art arrangement shown in FIG. 2, wherein a single hinge axis x existed between page g and the hinged connection h at its platform leaf p, at the ends of rigid strip RS. If a substantial number of pages lie atop leaf g below platform leaf p, it will become apparent that a book using the construction of FIG. 2 cannot lie flat when closed. The more pages lying atop leaf g, the more clockwise (in FIG. 2) the rigid connector strip RS must be pushed to accommodate those pages (unless, of course, succeeding leaves located atop leaf g were to have diminishing width dimensions, a situation deemed intolerable in view of the cost and complexity of cutting and collating successive leaves having decreasing width dimensions). Further, as added leaves are located above leaf g, requiring that strip RS rotate clockwise, it will become apparent that the edges of platform leaf p must move rightwardly (in FIG. 2), undesirably moving the platform leaf p progressively rightwardly, so that the distance from the spine axis at which the platform page could be placed would undesirably vary depending upon where within the book the user wished to insert the platform page.

Figure 3:
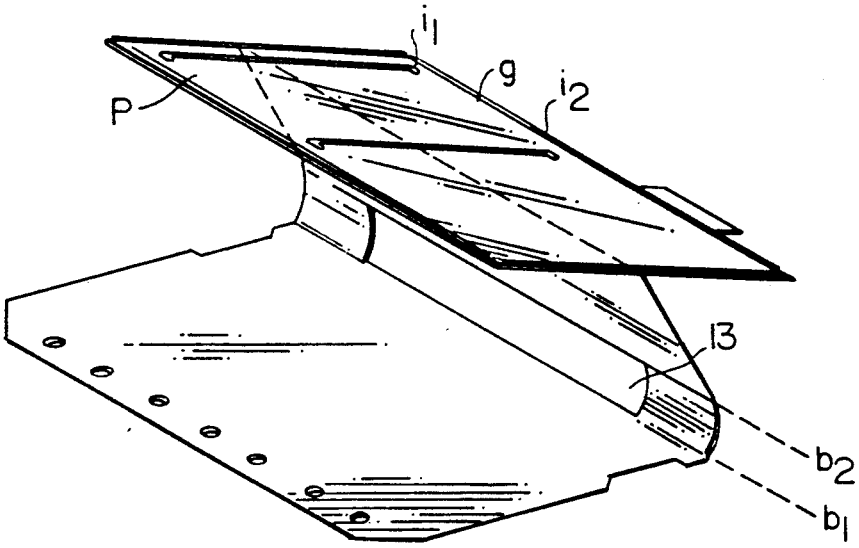
FIG. 3 is an isometric view of one form of hinged page assembly according to the present invention.

In FIG. 3 the platform leaf is shown including an overlying sheet g (of vinyl, for example) the four peripheral edges of which are cemented to the underlying portions (width portions e and f in FIGS. 8 and 9) of the platform leaf, with two horizontally extending slits $i_1$ and $i_2$ extending partially across that overlying sheet. With such an arrangement various pads or inserts may be readily attached to the platform leaf, with elongated tabs on the backs of such pads slid into slits $i_1$ and $i_2$, in the well-known manner in which supplement page collections are conventionally installed in lawbooks and other books intended to accommodate replacement "pocket parts". With such an arrangement it will be apparent that slits 17, 18 and 19 shown in FIG. 8 need not be provided.

Figure 4:
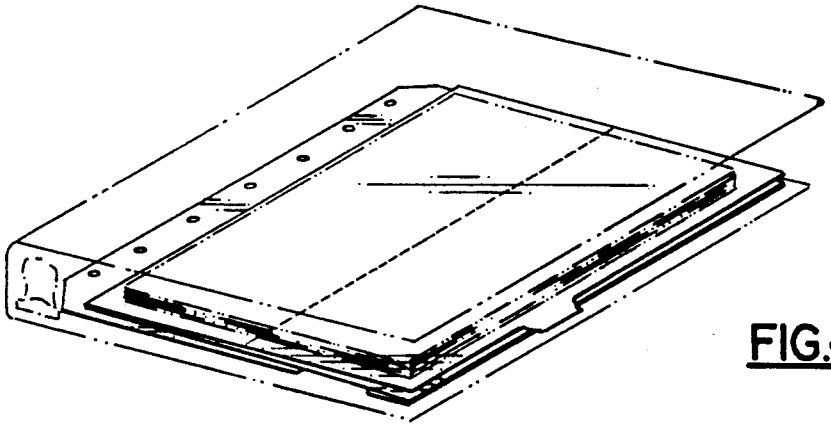
FIG. 4 is an isometric view of a preferred book form of the invention incorporating one hinged page assembly with the book shown in phantom lines in a closed position.
Figure 5:
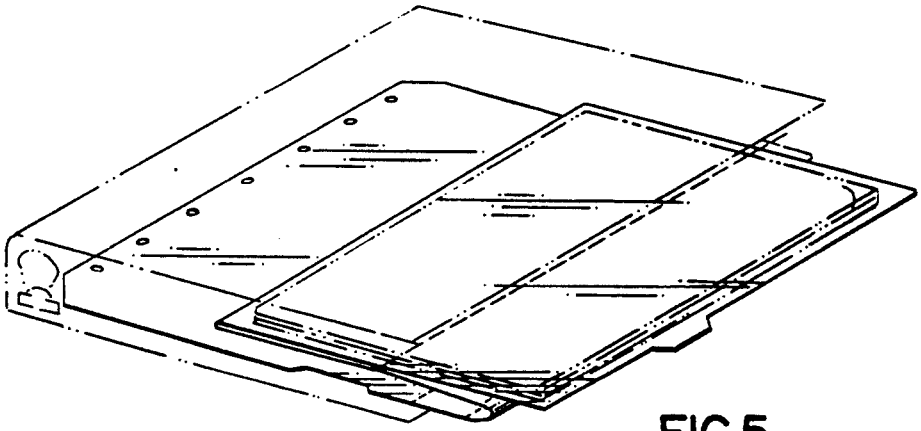
FIG. 5 is an isometric view of the book of FIG. 4 showing a hinged page partially slid from a normal toward an extended position, without opening a book shown in phantom.
Figure 6:
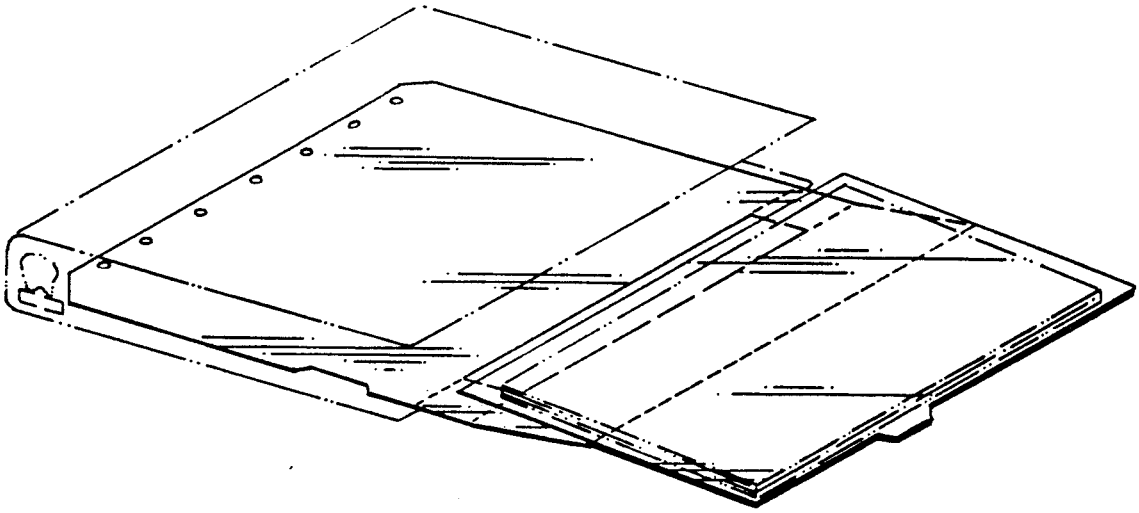
FIG. 6 is an isometric view of the book of FIG. 4 with the hinge page pulled to a fully extended position.

In FIGS. 4, 5 and 6 a hinged leaf is shown respectively in a normal position (FIG. 4), a partially-extended position (FIG. 5), and a fully-extended position (FIG. 6), with the hinged leaf comprising a "late" (or, if desired, penultimate) page of the book, which is shown in phantom lines in each of FIGS. 4–6.

Figure 7:
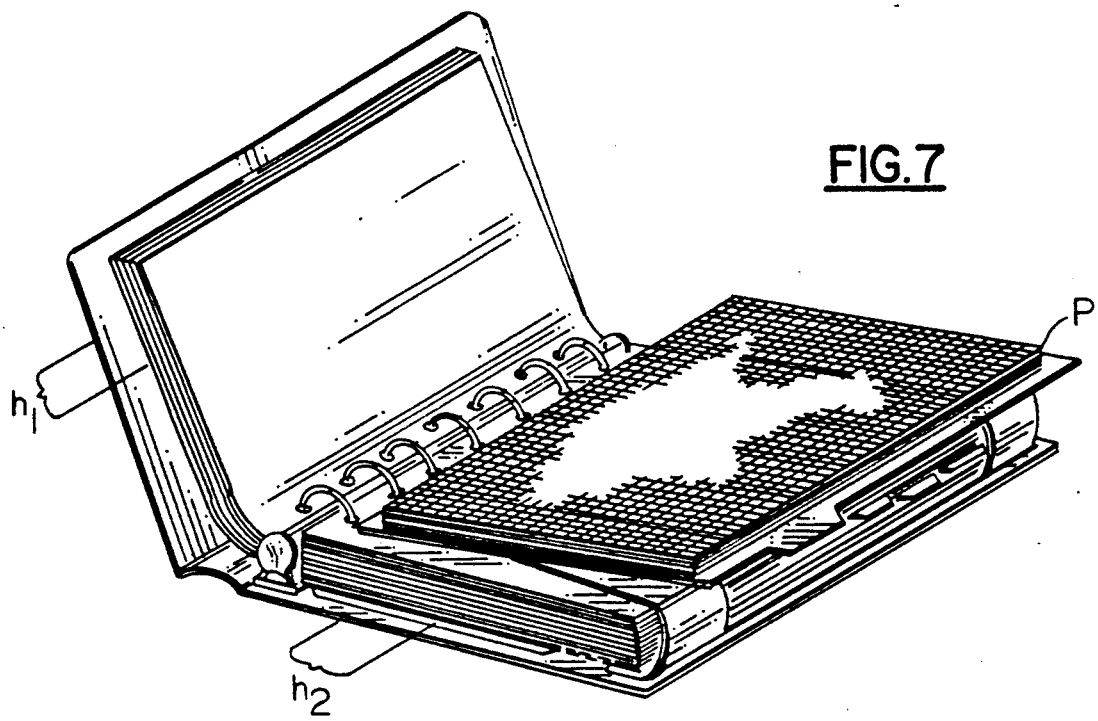
FIG. 7 is an isometric view of the book of FIG. 4 wherein the hinged page previously pulled to the extended position shown in FIG. 6 has been moved over and laid atop an inside page of the book, with the book being shown in solid lines in FIG. 7.

In FIG. 7, the hinge leaf is shown with pad P on its platform leaf inserted roughly-midway between the ordinary leaves of the book, a beginning group of ordinary book leaves being shown at $h_1$, and a later group of such leaves being shown at $h_2$. Tabs are not shown on pages of group $h_1$, but it will be apparent that they readily could be so provided.

Figure 11:
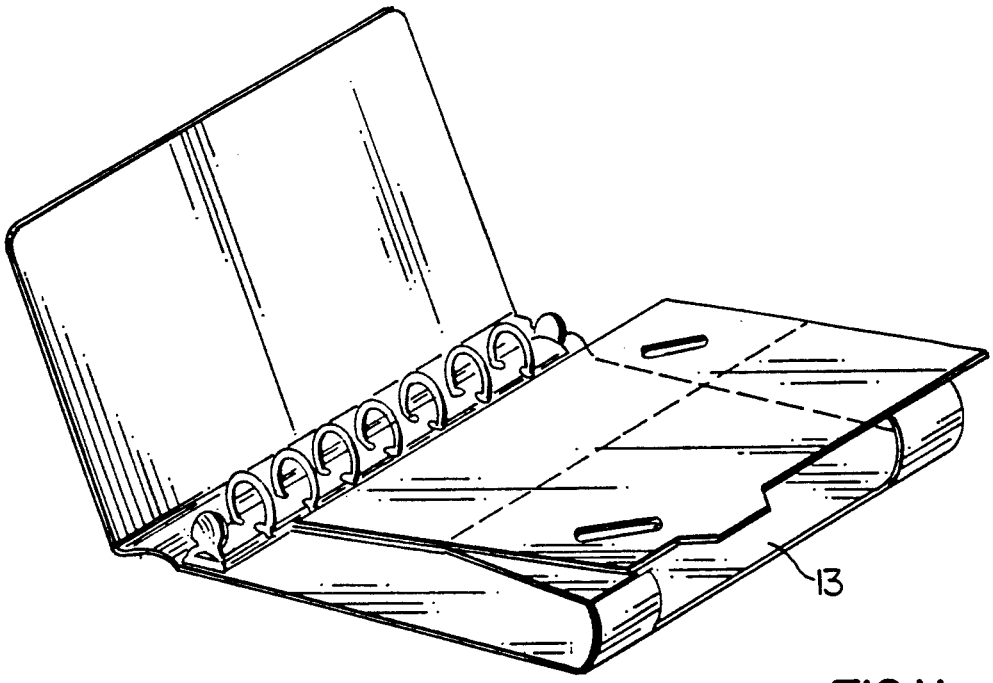
FIG. 11 is an isometric view of a modified form of the invention in which the hinged page forms the rear cover of a book having a conventional ring binding at its spine.

After folding and gluing of the stamping of FIGS. 8 and 9, the platform leaf carries a pair of slots 18, 19 as best seen in FIG. 10. In FIG. 10 a pad P comprises a plurality of sheets carried on a cardboard backing sheet B typically using a conventional gum strip to removably bind the pad sheets to the backing. Near diagonally-opposite corners of the cardboard backing right-angle pairs of cuts through the cardboard backing at 24,25 allow tangs or tongues of that backing to be pulled down and then inserted into slots 18,19, thereby removably fastening pad P to the platform leaf. In FIG. 11 an optional multi-compartment plastic cover CV is shown cemented to the innermost width portion of the hinge leaf assembly to carry desired articles such as paper clips, erasers, a small electronic calculator, and other desired supplies.

Figure 12:
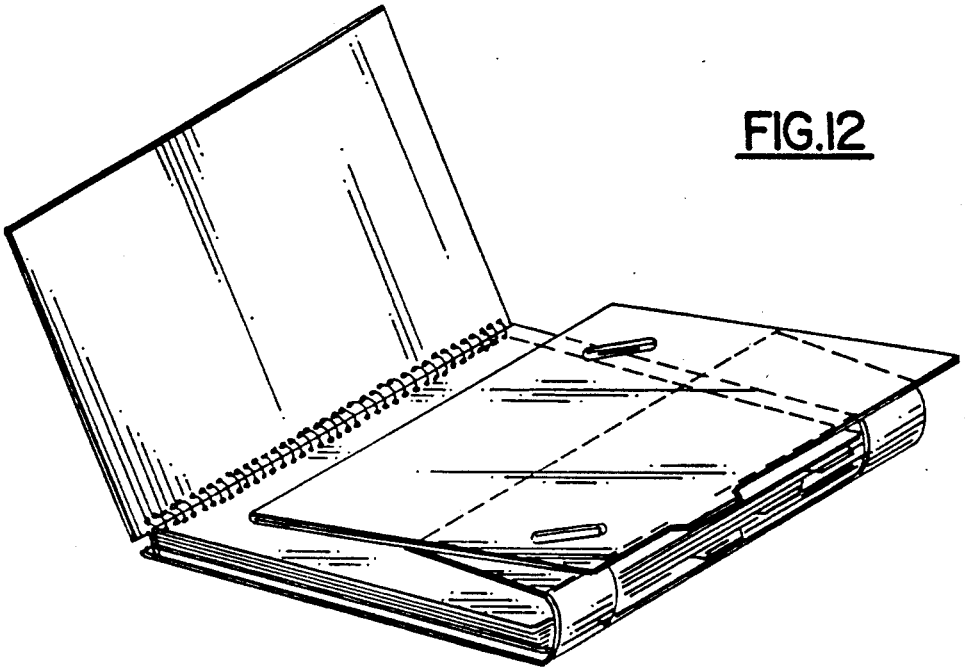
FIG. 12 is an isometric view of a wire-bound book incorporating one form of the invention as the back cover of a book.

While the hinge leaf assemblies described in connection with FIGS. 1 and 3–10 have been shown as leaves adapted to be mounted in between the front and rear covers of a book, it is important to recognize that either cover of a book may be formed to comprise a portion of a hinge leaf assembly. In FIG. 11 the rear cover of a book having a ring binder is shown as comprising a portion of a hinge leaf assembly, and in FIG. 12 the rear cover of a book having a conventional wire-binding is shown as comprising a portion of a hinge leaf assembly.

Figure 13:
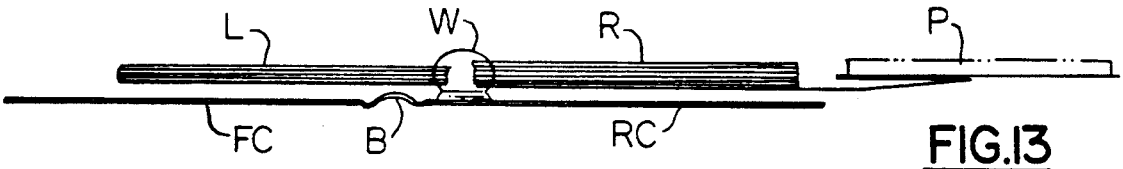
FIG. 13 is an end elevation view illustrating a wire-bound book incorporating one hinge page according to the invention, with a platform portion of the hinge page pulled out to a fully extended position.
Figure 14:
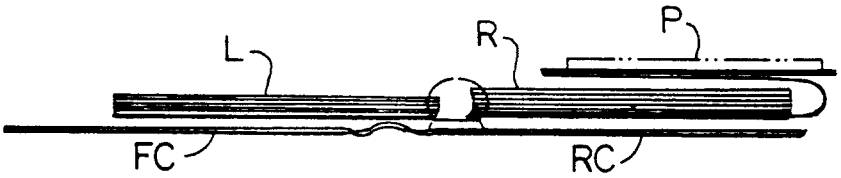
FIG. 14 is an end elevation view illustrating a wire-bound book incorporating one hinge page according to the invention, with a platform portion of the hinge page placed atop a righthand page to be viewed immediately adjacent a lefthand page of the book.

In FIG. 13 a book having a binding means at W, a front cover FC, a rear cover RC and a backing B interconnecting the covers, is shown with a single hinge leaf assembly inserted as the last inside leaf in the book, with the platform page P of the hinged leaf pulled to an extended position. In FIG. 14 the same book as that of FIG. 13 is shown with the platform page moved to atop a rightside inside page of the book, to place the platform page beside a leftside inside page of the book.

Figure 16:
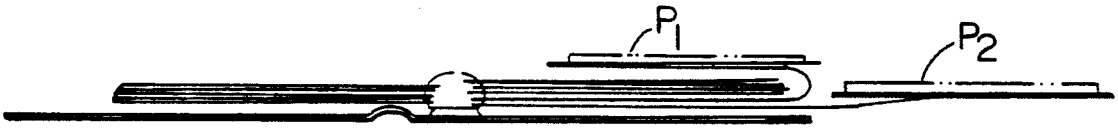
FIG. 16 is an end elevation view showing the two hinge pages of the book of FIG. 15 moved to exemplary positions.

In FIG. 15 a book is shown provided with two hinge leaf assemblies, one of which is shown as the last inside leaf within the book, and the other of which is shown as the penultimate inside leaf within the book, and in FIG. 15 the platform pages of both hinge leaf assemblies are shown positioned under a group of rightside pages, so as not to be visible (except for any edge tabs, not shown, which they might carry). In FIG. 16 the same book as that of FIG. 15 is shown with the platform pages $P_1$ and $P_2$ of the hinge leaf assemblies pulled to selected positions where they may be viewed side by side. It is not necessary that both hinge leaf assemblies be extended; i.e., each may be moved to an extended position or left nested between other pages independently of each other.

While FIGS. 15 and 16 show the use of two hinge leaf assemblies which extend in the same direction from the spine of a book, it should be noted that books may contain opposite-hand hinge leaf assemblies, as is illustrated in FIGS. 17 through 20. In FIGS. 17 and 18 two opposite-hand hinge leaf assemblies are shown between the covers of a book, with their platform pages in two alternate positions. In FIGS. 19 and 20 the front and rear covers FC and RC form portions of two opposite-hand hinge leaf assemblies to operate similarly.

While the embodiments described above have shown hinge leaf assemblies which were either bound or grasped near the spine of a book, or which formed a portion of the cover of a book, it should be noted that a hinge leaf assembly of the invention may be secured within a book by various other means. In FIG. 21 a hinge leaf assembly is provided with two fingers F,F adapted to slide into two pockets SL1, SL2 provided in conventional fashion on the inside of the rear cover of a book.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawing shall be interpreted as illustrative and not in a limiting sense.

The embodiments of the invention in which an exclusive property or privilege is claimed are defined as follows:

1. An assembly for a book having predetermined dimensions, including a spine height, a page width, and a book thickness, comprising:

a generally rectangular sheet having a plurality of side-by-side width portions, a first of said width portions having a width approximating said page width and a side edge having means for fastening said side edge in a book adjacent the spine of said book, a second of said width portions being hingedly connected to said first width portion, having a width equalling or exceeding said book thickness, and having at least one aperture between the upper and lower extremities of said second width portion.

a third width portion hingedly connected to said second width portion and having a width approximately half of said page width, and a fourth width portion having a width approximately said page width, said third width portion being hingedly connected to said fourth width portion at approximately the lateral centerline of said fourth width portion.

2. The assembly of claim 1 having a notch cut out along the upper edge of said first of said width portions.

3. The assembly of claim 1 having a notch cut out along the lower edge of said first of said width portions.

4. The assembly of claim 1 wherein the hinged connection of said first width portion to said second width portion comprises a fold line formed at the juncture of said first and second width portions.

5. The assembly of claim 1 wherein said fourth width portion included a pocket into which the backing of a pad may be inserted to removably secure said pad to said fourth width portion.

6. The assembly of claim 1 wherein said fourth width portion includes a plurality of slots adapted to accept tongues extending from the backing of a pad to removably secure said pad to said fourth width portion.

* * * * *

UNITED STATES PATENT AND TRADEMARK OFFICE

CERTIFICATE OF CORRECTION

PATENT NO. : 5,240,340

DATED : Aug. 31, 1993

INVENTOR(S) : Peter F. Lynch; Scott W. Osiecki; Robert L. Naas

It is certified that error appears in the above-identified patent and that said Letters Patent is hereby corrected as shown below:

In Col. 10, line 5, change the period to a comma
Col. 10, lines 7-8 change "approximately" to --approximating--
Col. 10, lines 9-10 change "approximately" to --approximating--
Col. 10, line 23 change "included" to --includes--

Signed and Sealed this

Fifth Day of July, 1994

Bruce Lehman

*Attest:*

BRUCE LEHMAN

*Attesting Officer*

*Commissioner of Patents and Trademarks*